United States Patent [19]

Österberg

[11] Patent Number: 4,652,736

[45] Date of Patent: Mar. 24, 1987

[54] GUIDE LINE IN AN ENDLESS TRAVELLING WEB

[75] Inventor: Lars B. Österberg, Halmstad, Sweden

[73] Assignee: Nordiskafilt AB, Halmstad, Sweden

[21] Appl. No.: 668,640

[22] Filed: Nov. 6, 1984

[30] Foreign Application Priority Data

Nov. 16, 1983 [SE] Sweden ..... 8306302

[51] Int. Cl.[4] ..... G01N 21/80

[52] U.S. Cl. ..... 250/571

[58] Field of Search ..... 250/548, 561; 139/424, 139/425 R

[56] References Cited

U.S. PATENT DOCUMENTS 2,955,969 10/1960 Runton ..... 139/425 R 4,293,841 10/1981 Potter ..... 250/548

*Primary Examiner*—Gene Wan

*Attorney, Agent, or Firm*—Kane, Dalsimer, Kane, Sullivan & Kurucz

[57] ABSTRACT

In a machine cloth is disposed a guide line which extends in the crosswise direction of the cloth. The configuration of the guide line is sensed by sensors and is displayed on a screen so that distortions or deviations in the machine cloth becomes visible to the operators who may rapidly take measures to correct the incorrect position of the machine cloth.

14 Claims, 1 Drawing Figure

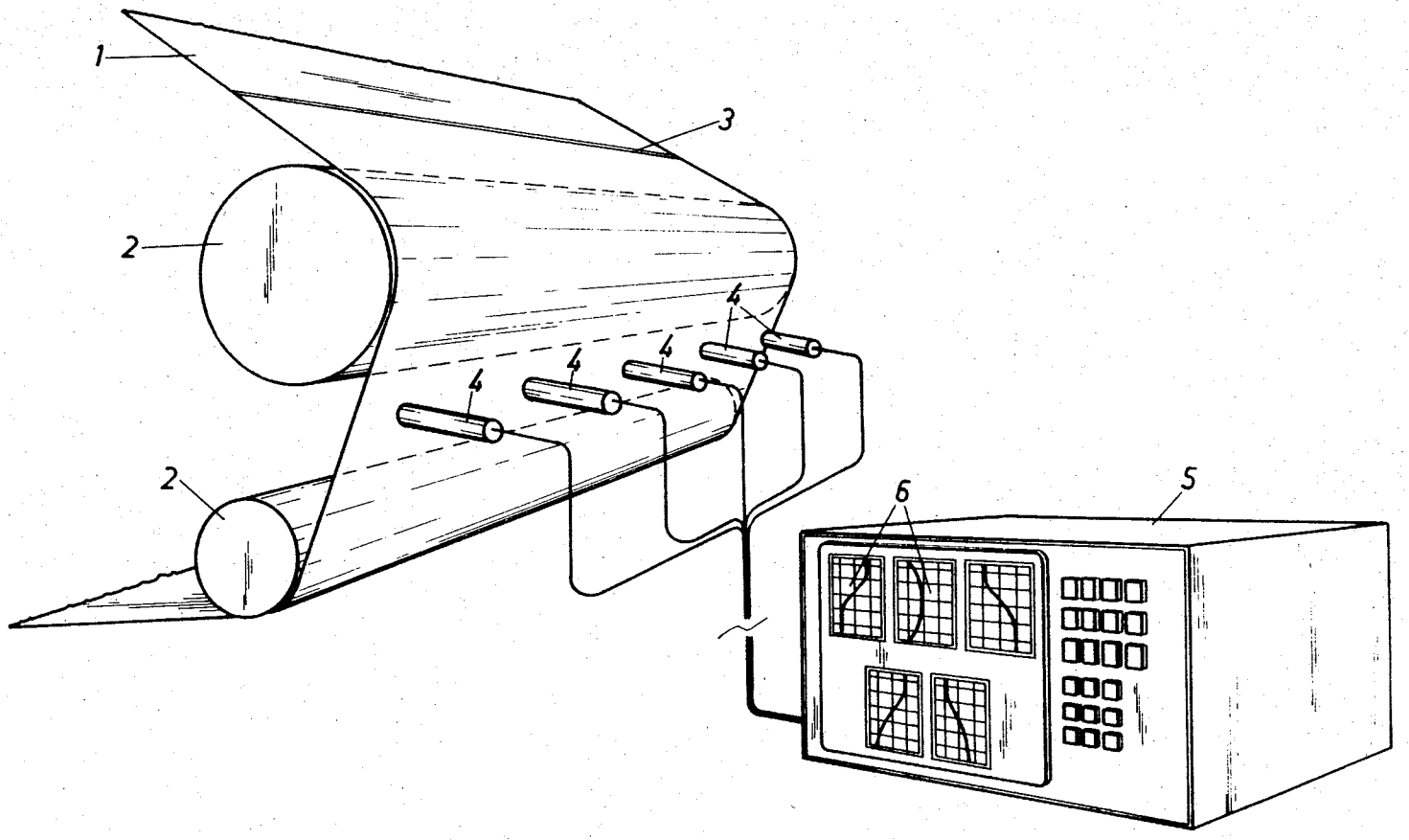
1
2
2
3
4
4
4
4
5
6

GUIDE LINE IN AN ENDLESS TRAVELLING WEB

BACKGROUND OF THE INVENTION

The subject invention concerns a guide line which is intended for the various kinds of machine cloths used in the papermaking, cellulose and similar industries such as forming fabrics, press felts, dryer cloths and the like, and which line is disposed in the machine cloth across the direction of travel of the latter.

Papermaking machines generally consist of three sections, viz. the forming section, the press section and the dryer section. The formation of the pulp into a paper sheet is effected in the forming section on a forming fabric or between two forming fabrics. As a rule, the forming fabrics are textile fabrics woven from monofilament, multifilament or metal threads. In the press section, the majority of the moisture remaining in the paper web is removed by pressing when the paper web travels through a plurality of press nips. In each press nip a felt or wire travels in parallel with the paper web through the nips. The felt preferably is a textile base weave made from spun yarns or filament onto which a fibrous batt is needled. Press fabrics have a construction equal to that of forming fabrics, only coarser. In the dryer section, the paper web is dried to suitable moisture contents. The drying is effected through abutment of the paper web against heated dryer cylinders. The force of abutment of the paper web against the cylinder is increased with the aid of a dryer felt or dryer screen which serves to press the paper web against the cylinder. Both dryer felts and dryer screens are textile fabrics. The felt may consist of a base weave onto which a batt is needled or of a weave alone. The dryer screen generally is a multilayered monofilament or multifilament weave. All machine cloths in a papermaking machine travel in endless condition over a number of rolls having varying functions. The endless condition is effected either by weaving the cloth endless or by interconnecting the cloth ends in the manufacture or in the installation of the cloth.

A machine cloth is a flexible unit in which the regular array of perpendicular lengthwise and crosswise threads may be distorted. When the distorsion surpasses a certain angle ridges or creases form in the lengthwise direction of the machine cloth. The travelling machine cloth has a certain lengthwise tension therein and since the cloth itself like the system of rolls incorporated in the travelling loop are not perfect, problems of guidance and control may arise as a result of the often considerable web travelling speeds of up to and above 1000 m/min. The machine cloth is guided by a roll or rolls in the system that may be positioned obliquely. Some machine cloth webs have an automatic system built into them so that in case the web is displaced and migrates too far to one side an edge sensing device is arranged to affect the operation of the guide roll.

Particularly in the case of press felts it is common practice to provide a guide line on the felt proper to allow the staff working on the papermaking machine to establish by visual inspection the manner in which the felt travels and to correct the felt orientation manually, should the felt bias on distortion have become too large. Woven press felts and press fabrics are provided with guide lines by introduction of a number of coloured threads into the weave. Application of guide lines in needled felts used to be made through painting but this method is both work-consuming and unsatisfactory. In latter years, subliming dyes have been used which are transferred by heat from a paper sheet onto the felt. This method, although an advantage from a technical and manufacturing point of view, at the same time has a negative effect on the durability of the guide line. This is particularly true in the case of felts comprising fibres of polyamides, since the subliming dyes cannot satisfactorily be chemically bonded to polyamide fibres. Particularly the wet strength of the guide line is unsatisfactory and sometimes the dye disappears rather quickly.

However, considerable problems are connected in establishing the shape and configuration of the guide line by visual inspection, when the felt travels at speeds in the neighbourhood of 1000 m/min. In addition, the felt soon becomes dirty and for this reason alone it may be impossible to see the line. Gradual distortion of the guide line is also difficult to register, particularly since the papermaking machine is in operation 24 hours a day and the staff is replaced continuously. Another disadvantage inherent in painted guide lines are the disturbances and vibrations that may be caused by the guide line.

SUMMARY OF THE INVENTION

The above problems of a technical nature are solved generally therein that the machine cloth contains a signal-emitting element which is disposed in the transverse direction across the cloth. A number of stationary sensors are mounted in the papermaking machine in the transverse direction thereof to sense the position of the signal-emitting element and to transmit information about its position to a receiver, preferably a computer system including a display or a plotter. The time differences between the signals emitted by the various sensors calculated in relation to the speed of the machine cloth provides the data indicating the position of the signal-emitting element at the points where the sensing operation has been performed and a line interconnecting these points reflect the configuration of the signal-emitting element and thus the cross-wise profile of the machine cloth. The data on the sensed profile may be stored and used for comparison with the results of subsequent sensing measurements to determine whether or not the crosswise profile of the machine cloth has changed.

Several different embodiments and forms of guide lines are possible, depending on the type of signal one wishes to use. Preferably, the guide line consists of an electrically conductive material, whereas the rest of the machine cloth is made from an electrically non-conductive material. For instance, the guide line could consist of an electrically conductive thread material or of a zone with chosen magnetic characteristics. In accordance with another embodiment the guide line consists of a light-sensitive material whereas the rest of the machine cloth is made from a material which is not light-sensitive. The light sensitivity in the guide line may be obtained by treatment of a generally not light sensitive material.

Preferably, the guide line is divided into two or several sub-units spaced a certain distance apart. When the first pulse is generated by a sensor a timer is started. If another pulse is generated at a predetermined interval from the first pulse the pulses are registered. If the opposite is the case, the first pulse is regarded as disturbance.

The guide line is used in a device in which the machine cloth travels in an endless path. The device comprises a number of stationary sensors which are positioned exteriorly of the web and across the direction of travel of the latter so that when the guide line travels past each sensor the latter emits a signal to a computer system which is arranged to measure and register the time differences between the signals emitted by the individual sensors. In accordance with a first embodiment, the sensors are inductive and arranged to scan an guide line consisting of magnetic material. In accordance with a second embodiment a voltage is applied on the guide line at least as the latter passes the sensors. The applied voltage is sensed by a voltage-registering transducer. In accordance with yet another embodiment the sensors are photoelectric cells which scan the felt or wire to detect a light-sensitive guide line. A memory may be arranged to register the time differences between the emittance of signals from the various sensors and to store these signals for comparison of the distortion in the web. The registration of time differences between signal emittance from the various sensors preferably appears on a display one axis of which indicates the time differences and the other one the position of the sensors in the transverse direction of the web.

Further characteristics of the invention will appear from the dependent claims.

BRIEF DESCRIPTION OF THE DRAWING

The invention will be described in closer detail in the following with reference to the accompanying drawing giving a schematic representation of the inventive object.

DETAILED DESCRIPTION OF PREFERRED EMBODIMENTS

In the drawing FIGURE, reference numeral 1 denotes a machine cloth wire, such as forming fabric, press felt, dryer cloth or the like, which travels in endless condition over a number of rolls 2. The machine cloth is provided with an guide line 3. The guide line preferably consists of threads of an electrically conductive material which are woven into one or several zones of the machine cloth. Preferably, the electrically conductive material is also magnetic. One or several zones may likewise be given chosen magnetic properties or may be made from a light-sensitive material. Fixed sensors 4 are positioned exteriorly of the machine cloth in the transverse direction of the cloth, the nature of said sensors depending on the nature of the guide line that is used. When the orientation line is magnetic the guide line is sensed by inductive magnetic transducers. It is likewise possible to apply a voltage across an electrically conductive zone across the cloth and to sense the voltage by means of sensors 4 comprising a voltage measuring unit. Zones of a light-sensitive material may be sensed by sensors in the form of photoelectric cells.

When the guide line travels past a sensor 4 a signal is emitted to a computer system 5. In case the guide line is not straight—it may for instance run ahead in the middle or at one edge—it will not pass all the aligned sensors 4 at the same time. The resulting time differences in line passage are evaluated and are registered by a computer system. The computer system may include a display 6 or an XY plotter. Along one axis of the display 6 or the plotter may be indicated the time differences between the signals received from the individual sensors and along the other axis the position of the individual sensors in the crosswise direction of the web. When the points representing the signals from the various sensors emitted at each passage of the guide line are interconnected a curve is displaced on the display 6 or the plotter and this curve is identical with the configuration of the guide line and thus represents the distorsion of the guide line. In the drawing figure, the computer system 5 is shown to comprise five displays 6. In the displays are represented various examples of displacement or distorsion of the guide line 3, that is, of the machine cloth 1. The signals may be stored in the memory of the computer and later be shown on the display or plotter for comparision with up-to-date curve of the guide line.

To eliminate random disturbance pulses the felt 1 is preferably provided with two guide lines spaced a certain distance apart. The first pulse generated by a sensor initiates the operation of a timer. If another pulse is not received from the same sensor within the estimated time interval the first pulse is regarded as disturbance.

The signals emitted from the sensors to the computer may also be used for other purposes, such as to register the duration of one rotation of the felt.

What I claim is:

1. An improved guide line intended to be used in machine cloths, such as forming fabrics, press felts, dryer cloths, and the like, in the papermaking, cellulose and similar industries, said guide line disposed across the direction of travel of said machine cloth, the improvement comprising said guide line consisting of a material having characteristics so deviating from the characteristics of the material making up the rest of said machine cloth as to allow scanning of said guide line.

2. An improved guide line as claimed in claim 1, wherein said guide line is made from an electrically conductive material whereas the rest of said machine cloth is made from an electrically non-conductive material.

3. An improved guide line as claimed in claim 1, wherein said guide line is made from a light-sensitive material whereas the rest of said machine cloth is made from a material which is insensitive to light.

4. An improved guide line as claimed in claim 2, wherein said electrically conductive material is a thread material.

5. An improved guide line as claimed in claim 2, wherein said electrically conductive material consists of a zone having selected magnetic properties.

6. An improved guide line as claimed in claim 1, the improvement comprising said guide line being divided into a number of units extending crosswise and spaced predetermined distances apart in the direction of travel of said machine cloth.

7. An apparatus for sensing distortions or deviations in an endlessly travelling machine cloth, such as a forming fabric, a press felt, a dryer cloth or the like in the papermaking, cellulose and similar industries comprising:

a guide line disposed across the direction of travel of said machine cloth, said guide line possessing characteristics differentiating said guide line from the rest of said machine cloth so as to allow scanning of said guide line, a plurallty of stationary sensors disposed exteriorly of said cloth across the direction of travel of said cloth, a computer system for scanning said guide line with said sensors upon the passage of said guide line past said sensors, said sensors emitting a signal to said computer system, said computer system arranged to measure and register the time difference between signals emitted from each of said sensors.

8. The apparatus of claim 7, wherein said sensors are inductive transducers arranged to scan an orientation line consisting of a magnetic material.

9. The apparatus of claim 7, wherein said guide line consists entirely or partially of an electrically conductive material, a voltage being applied on said orientation line at least upon passage of said line past said sensors, said sensors registering said voltage.

10. The apparatus of claim 7, wherein said guide line consists entirely or partially of a light-sensitive material and wherein said sensors are photoelectric cells.

11. The apparatus of claim 7, wherein a memory is arranged to register said time differences between signals emitted by said individual sensors and to store said signals for comparison of distortion of the guide line at different times.

12. The apparatus of claim 7, comprising a memory arranged to register said time differences between signals emitted by said individual sensors and to store said signals for comparison of distortion of the guide line at different times, and a display arranged to register said time differences between signals emitted from the various sensors in visual form.

13. The apparatus of claim 7, comprising a memory arranged to register said time differences between signals emitted by said individual sensors and to store said signals for comparison of distortion of the guide line different times, and a display arranged to register said time differences between emittance of signals from the various sensors in visual form, one axis on said display indicating said time differences between said emitted signals and the other axis indicating the positions of said sensors in the transverse direction of said machine cloth.

14. The apparatus of claim 7, wherein each sensor generates at least two pulses at predetermined time intervals in order to allow registration.

* * * * *